United States Patent [19]

Scoutten

[11] 3,947,026

[45] Mar. 30, 1976

[54] BILLIARD TRAINING DEVICE

[76] Inventor: Robert J. Scoutten, 3 Laurel Way, Kentfield, Calif. 94904

[22] Filed: Apr. 24, 1975

[21] Appl. No.: 571,272

[52] U.S. Cl. ..... 273/2; 33/289

[51] Int. Cl.[2] ..... A63D 15/00

[58] Field of Search ..... 273/2, 14; 35/29 R; 33/289

[56] References Cited

UNITED STATES PATENTS

| | | | |
|---|---|---|---|
| 3,410,555 | 11/1968 | Murch | 273/2 |
| 3,411,779 | 11/1968 | McGowan | 273/2 |
| 3,711,091 | 1/1973 | Dixon | 273/2 |
| 3,843,120 | 10/1974 | Ricci | 273/2 |

*Primary Examiner*—Paul E. Shapiro
*Attorney, Agent, or Firm*—Flehr, Hohbach, Test, Albritton & Herbert

[57] ABSTRACT

A billiard training device (e.g., for games of pool, snooker or billiards) for simultaneously providing a visual indication of desired point of aim for the cue ball and desired point of contact with an object ball, to propel the latter in a predetermined desired direction. The device can be unitary in construction, with a relatively flat indicator surface at substantially one half the height of the cue ball. The indicator surface can also be of the same diameter as the cue ball, and can be provided with indicia to locate both the desired point of contact on the object ball and desired point of aim for the cue ball. In use, the device is positioned immediately adjacent an object ball to indicate both the desired point of contact and point of aim. Through repeated use in practice, a player can learn both the "feel" and principle of correct aim, and thus perfect his playing ability. To facilitate visual training, the device can also be constructed of transparent material.

17 Claims, 6 Drawing Figures

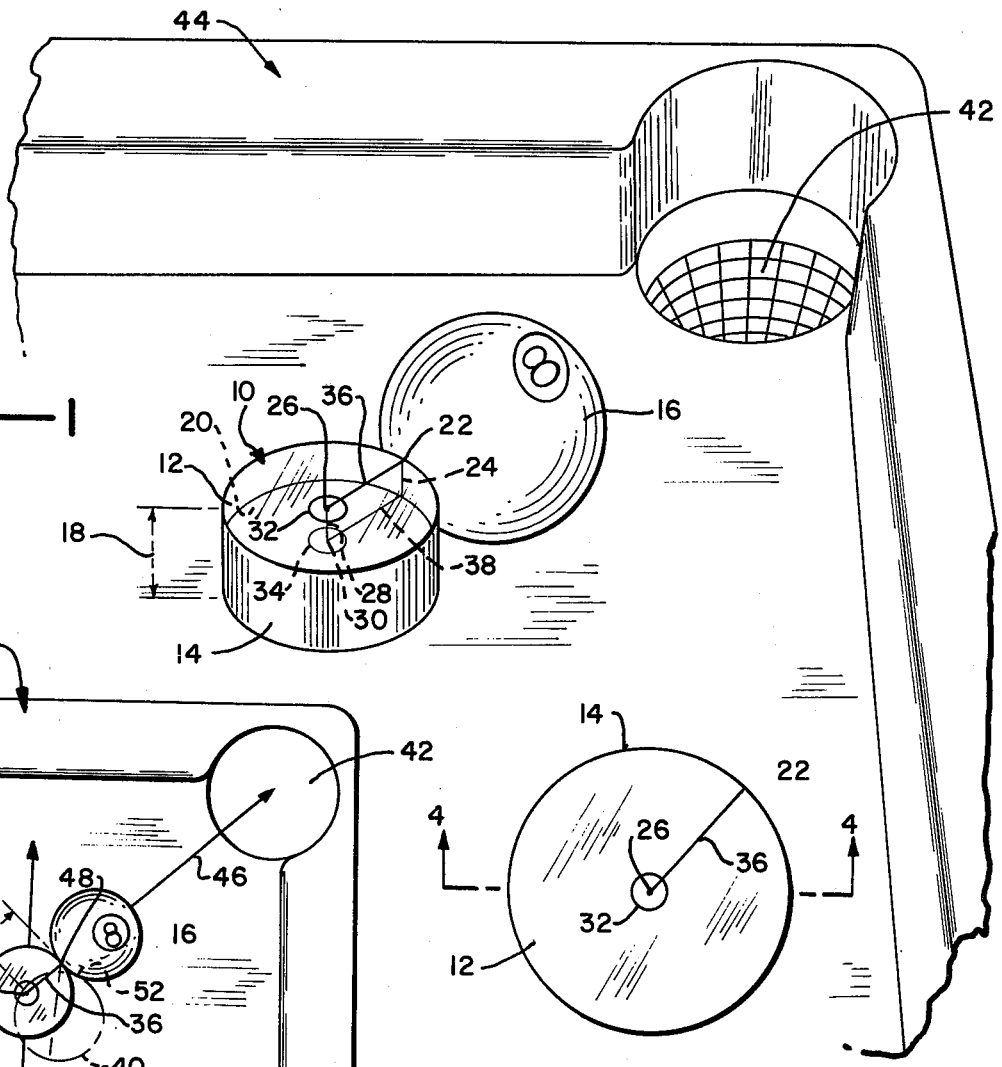
FIG.—1
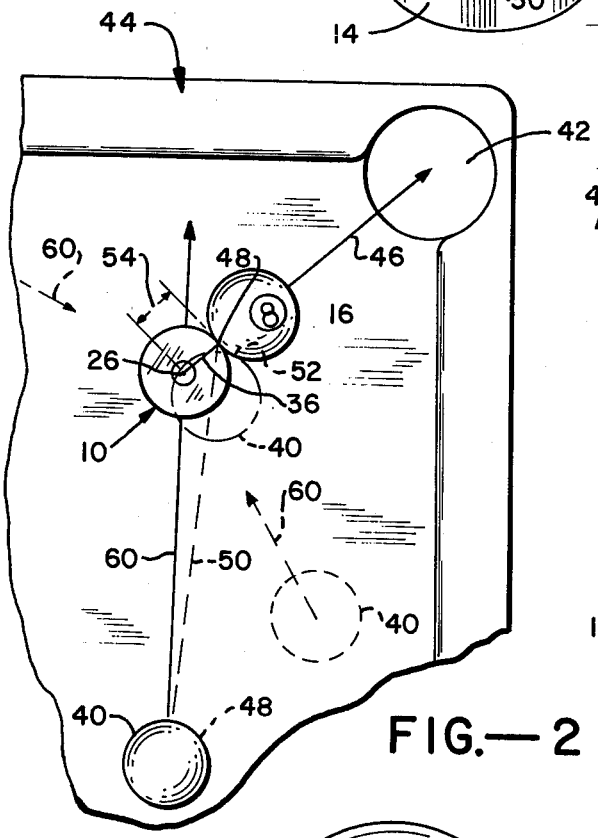
FIG.—2
FIG.—3
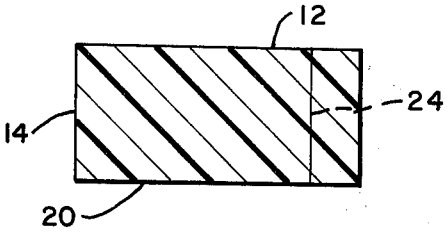
FIG.—4
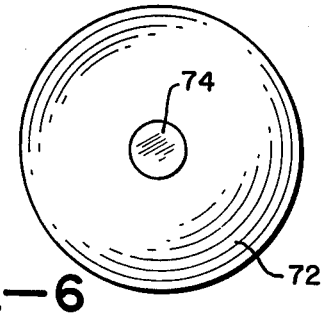
FIG.—6
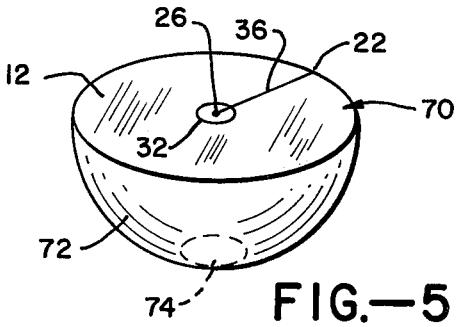
FIG.—5

BILLIARD TRAINING DEVICE

BACKGROUND OF THE INVENTION

It is generally recognized that success in games known as "billiards" (e.g., pocket billiards, American snooker, carom billiards) is dependent upon proper aiming and a knowledge of angles and deflections. It is particularly important that the player properly determine the precise point of aim for an accurate shot if, thereafter, he is to skillfully and successfully execute the shot. While the latter is a matter of practice and experience, no amount of practice or experience will provide an effective shot if the initial point of aim is incorrectly determined.

Contrary to popular belief, the correct point of aim is not necessarily an imaginary spot on the object ball. To illustrate, the novice or beginning player will frequently assume that the desired point at which the periphery of the cue ball should contact the object ball is also the correct point for aiming the center of the cue ball. However, the knowledgeable or "expert" player knows this assumption to be incorrect, and that the true point of aim for the center of the cue ball is spaced from the object ball (along the intended line of travel of the latter) a distance which is equal to one half the diameter of the cue ball. The knowledgeable player also knows that if the cue ball is shot so that its center passes over this "true" point of aim (without English) the object ball will move along the intended line of travel, viz., to a pocket or desired point for rebound on the periphery of the table. The problem of determining a correct point of aim is complicated by the fact that, whereas many players will routinely aim the center of the cue ball, others will effectively aim a particular peripheral portion of the cue ball at the desired point of contact, with substantially identical results. As a consequence, the principle of true point of aim is generally misunderstood, even by players who play at billiards with relative frequency, and is often poorly or incorrectly explained by many would be experts on the subject.

Some efforts have recently been made to correctly present the principle of true point of aim, and to provide devices which would teach such principle to the beginning or novice player. Particular devices for such purpose are disclosed, for example, in Miller Pat. No. 3,220,122, Murch Pat. No. 3,410,555, and McGowan Pat. No. 3,411,779. In general, such devices are cumbersome and unwieldy and undesirably complex in nature. The devices are, moreover, not truly suited for training purposes, and are soon discarded as impractical for the intended purpose.

A simple, inexpensive, easily used device for training and teaching the principle of true point of aim is therefore highly to be desired.

SUMMARY AND OBJECTS OF THE INVENTION

The present invention relates generally to training devices for use in teaching pocket billiards and billiards, and more particularly to a training device for simply and easily indicating both the true point of aim for a cue ball and the desired point of contact for the cue ball with respect to an object ball.

In general, it is an object of the present invention to overcome the defects of prior devices, as noted above, and to provide an improved billiard training device for the general purpose described.

It is a particular object of the invention to provide a billiard training device for visually indicating the desired point at which the cue ball should contact an object ball, and for teaching the correct point of aim for the cue ball.

It is another object of the invention to provide a billiard training device of such character which is unitary in construction and capable of use for teaching purposes by the player, without interference with the player's initial determination of either the desired point of contact or the true point of aim.

Still another object of the invention is to provide a billiard training device of such character which is small and light in weight, which may be transparent and which simultaneously provides a visual indication of both the correct point of aim and the desired point of contact as respects the cue ball and the object ball.

As a brief statement of the invention, I provide a billiard training device which is unitary in construction and which includes a relatively flat indicator surface at substantially one half of the height of the cue ball, as used in the particular billiard game. This indicator surface which may be circular in configuration and of a diameter substantially equal to that of the cue ball, includes indicia means to locate the critical point of aim and the desired point of contact with reference to the object ball. The unitary device particularly includes support means to facilitate the positioning of the flat indicator surface in desired position immediately adjacent an object ball, and without interference of the player's visual determination of point of aim and contact. In one embodiment, the support means comprises a transparent or translucent right cylinder of a diameter substantially equal to that of the cue ball, and includes the indicator surface as the top surface of the right cylinder. In another embodiment of the invention, the support means is in the form of a half cue ball, that is, it is a hemisphere which includes as its top surface the flat indicator surface described. In the latter case, the hemispherical unit is provided with a small flattened base to insure a proper horizontal positioning of the flat indicator surface adjacent the object ball.

In general, the training device of the present invention can be positioned immediately adjacent an object ball so that the indicia means for point of aim and point of contact lie on the intended line of travel of the object ball. The player can then observe the true relationship between the point of aim and the point of cue ball contact with the object ball, and by repeated experience with such placement of the training device, determine the true point of aim for virtually all shots encountered in playing games such as pocket billiards or billiards. The training device of the invention thus aids the novice in appreciating the concept involved in determining the true point of aim and in acquiring the skill necessary to correctly determine the desired point of aim for each individual situation which he may encounter. Moreover, through continued use of the training device, a player can develop a highly reliable and sophisticated "feel" for aiming either the center of the cue ball at the true point of aim, or a particular peripheral portion of the cue ball at the point of contact. The training device is thus versatile in adapting to differing styles of visualizing and making accurate shots.

Other features and advantages of the invention will be apparent from the following description taken in conjunction with the drawings.

BRIEF DESCRIPTION OF THE DRAWING

FIG. 1 is a fragmentary perspective view of a portion of a pocket billiard table, showing a billiard training device in accordance with the invention in position adjacent an object ball.

FIG. 2 is a plan view thereof, on a reduced scale, showing also the desired line of travel of the cue ball.

FIG. 3 is a top plan view, on a somewhat enlarged scale, of the billiard training device of FIG. 1.

FIG. 4 is a sectional view along the line 4—4 of FIG. 3.

FIG. 5 is a perspective view of another embodiment of a billiard training device in accordance with the invention.

FIG. 6 is a view in bottom plan of the device of FIG. 5.

DETAILED DESCRIPTION OF THE PREFERRED EMBODIMENTS

Referring to FIGS. 1, 10 generally represents a billiard training device incorporating the concepts of the present invention. As illustrated, the device is unitary, that is, it consists of a single element, and includes a relatively flat indicator surface 12 and an integral support member 14 which is adapted to position the indicator surface at substantially one half the height of a standard cue ball. In this regard, it is conventional that both the cue and object balls used in pocket billiards, as represented at 16, have a diameter of 2¼ inches. Accordingly, the height of the support member 14 (shown at 18 in FIG. 1) would be 1⅛ inches. An exception exists in the game known as "American Snooker" where the standard ball is 2⅛ inches in diameter. In this instance, the dimension 18 would be 1-1/16 inches. Also, the game known as "carom billiards" is usually played with a ball having a diameter of 2⅜ inches, thus requiring a dimension 18 of 1-3/16 inches. In any event, it is a feature of the present invention that the indicator surface 12 is supported so as to be substantially horizontal, and at a height 18 which corresponds to the center or zone of largest diameter of the cue ball employed in playing the game.

Referring again to FIG. 1, it will be seen that the support means 14 for the indicator surface 12 is generally in the form of a right cylinder. The training device 10 is therefore supported on the surface of the billiard table by means of a flat circular surface 20, which underlies the upper circular surface 12 in concentric fashion. As hereinafter explained, it is also a feature of the invention that the upper cylindrical surface is of a diameter that is substantially equal to the diameter of the cue and object balls. Since the embodiment of the billiard training device shown in FIGS. 1 – 4 is a right cylinder, the entire device has a diameter which is equivalent to that of the object ball 16. In other words, the cylinder 14, and the parallel circular faces 12 and 20, each have a diameter that is the same as the diameter of the object ball 16 and the other balls employed in playing the game. This assumes, of course, that the object ball 16 has the same diameter as the cue ball. However, in those instances where the cue ball might be larger (or smaller) than the object balls, for example, in a coin-operated pool table, the circular faces 12 and 20 of the training device would necessarily have the same diameter as the cue ball.

To facilitate use of the billiard training device 10, it is preferred that it be constructed of a transparent material such as clear plastic, glass or like material. Suitable plastic materials for such purpose include the polymers of acrylic and methylacrylic acid derivatives, which are characterized by their properties of colorless transparency and stability to light. Suitable glass compositions would be ones formulated for strength as well as transparency. The invention is not limited to transparent materials, however, and various opaque plastics, composition materials or glasses, could also be employed to provide some of the advantages of the invention. In general, use of a transparent material provides the advantage of a "see-through" characteristic which assists in use of the device 10 as a teaching or training aid, both with reference to point of aim and point of contact of the cue ball as respects an object ball.

As particularly illustrated in FIGS. 1 and 3, the device 10 is completed by the provision of various indicia means for locating the desired point of contact of the cue ball with repsect to an object ball, and for purposes of providing an indication of a true point of aim for the cue ball. Specifically, indicia means for indicating the desired point of contact can be a point 22 located on the peripheral edge of the circular surface 12, and can additionally include a vertical indicator line 24 on the periphery of the cylinder 14 which intersects the point indicator 22. As hereinafter explained, the indicia 22, 24 assist in locating the desired point of contact of the cue ball with the object ball.

Indicia means are also provided to locate the true point for aiming the center of the cue ball. As illustrated, such indicia means can include a dot or point 26 at the center of the upper circular surface 12, a vertical indicator coincident with the axis of the cylinder 14 and intersecting the point 26, an indicator point 30 positioned at the center of the lower circular face 20. Additional indicia means, such as slightly enlarged target circles 32 and 34 can be provided in concentric relation, respectively, on the upper and lower circular faces 12 and 20. As further illustrated in FIGS. 1 – 3, a horizontal indicator line 36 may be provided on the top surface 12 to interconnect the indicia points 22 and 26. In like fashion, a vertical indicator line 36 may be provided on the lower surface 20.

To describe the use of the billiard training device 10 as illustrated in FIGS. 1 – 4, it is assumed that the player intends to move the cue ball 40 (through use of a billiard cue) in a direction such that contact between the cue ball and the object ball 16 will cause the latter to proceed to the corner pocket 42 of the billiard table 44. For such purpose the desired or intended line of travel of the object ball 16 is represented by the arrow 46. In the described circumstance, the inexperienced or novice player might correctly determine the desired line of travel of the object ball to be the line represented in FIG. 2 by the arrow 46. He might also correctly determine the desired point of contact of the cue ball with the object ball to be the point represented at 48. However, as is often the case with the novice, he might then erroneously assume that the point of contact 48 was also the point at which he should aim the center of the cue ball 40. If successfully executed, an attempt to propel the cue ball at such incorrect point of aim would produce a line of travel as represented by the dotted line 50. The result of this error would be to cause the cue ball to actually contact the object ball at the point 52, rather than at the desired point 48. Many missed shots are no doubt due to this error in the assumed location of the point of aim, as respects the center of the cue ball.

As represented in FIG. 2, the true point of aim is to be found in an opposite direction along the line of intended travel 46 of the object ball 16, at a distance equal to one half the diameter of the cue ball. This distance is represented in FIG. 2 by the dimension 54. In accordance with the present invention, it is possible to position the billiard training device 10 so that the indicator point 26 is substantially directly above this true point of aim. Such result is accomplished by positioning the device 10 adjacent the object ball so that the indicator line 36 coincides with the intended line of travel 46, and so that the point of contact indicia 22 corresponds with the desired point of contact 48. This alignment is easily accomplished, visually, and can be completed within a few seconds time. The player can now determine the desired line of travel for the cue ball (represented by the arrow 60) which should pass through the center of the cue ball 40 and through the central indicia point 26 of the training device. With reference to FIG. 1, which is intended to represent the player's view of the circumstances presented in FIG. 2, the sighting points 22 and 26 are both clearly visible with reference to the object ball 16. In addition, for the illustrated training device 10, the additional sighting indicia for determining the true point of aim (specifically the lower indicia point 30 and the interconnecting vertical line 28), are clearly visible to the player. It will be appreciated that if the player correctly makes his shot so that the cue ball moves along the line 60 to the point initially occupied by the training device 10, that the contact with the object ball will be such that the object ball will move along the line 46 to the pocket 42. Of course, to accomplish such purpose, the training device must be removed and the player must direct the cue ball along the remembered line of sight. It will thus be seen that repeated use of the training device will familiarize the player with the true point of aim so that, in time, he will be able to accomplish the desired result without any necessity of using the training device. The developed skill in this instance would be the knowledge as to which part of the cue ball should be aimed at the point of contact.

In the case of a player who prefers to visualize the point of aim with reference to a peripheral point of contact on the cue ball (rather than through its center), the true point of aim might be indicated by the peripheral indicia 22, 24. In this case the line of travel would be visualized as parallel to the line 60 and extending from the point of contact 48 on the object ball to a similar point (dotted line position 48) on the cue ball.

In the use of the training device, as described, the transparency of the cylindrical support 14 assists in visualization of the point of aim. Specifically and regardless of the effects of parallax, the point of contact 22 and vertical line 24 are in clear view of the player in position to make a shot. The aiming points 26 and 30 and the interconnecting line 28 are likewise clearly visible through the transparent plastic, as are the target circles 32 and 34. The training device shown in FIG. 1 is additionally represented as having an opaque peripheral surface for the support 14, such modification serving to both emphasize the visual indicators observed through the top circular surface 12 and to obstruct duplicate and possibly confusing images as might be seen through the peripheral surface of the support. It will be appreciated that the described surface can be easily rendered opaque by the mere expedient of abrading or otherwise roughening the surface to render the same translucent rather than transparent.

It will be further appreciated that the training device 10 can be used in the manner described, regardless of the location of the cue ball. Thus assuming shots from other locations of the cue ball 40, as represented by the dotted line configurations, indicia 26, 28, 30 will always indicate the true point for aiming the center of the cue ball, as well as the direction of travel 60 of the cue ball. In each case, the ultimate object is to have the cue ball pass directly over the true point of aim so that the point of contact will be the point 48 on the object ball 16.

Keeping in mind the principles just described, the billiard training device of the present invention can take various forms. Thus FIGS. 5 and 6 illustrate a modified embodiment 70 wherein the support means for the indicator surface 12 is generally in the form of a solid hemisphere 72. For such embodiment, the lower support surface, represented at 74, can be a small diameter circular surface which is parallel to the circular indicator surface 12. In other respects, the indicator surface can be provided with indicia means substantially as in the previously described embodiment, that is, indicia 22 for the point of contact and indicia 26 for aiming the center of the cue ball, and an interconnecting indicator line 36. As a practical matter, the billiard training device 70 can be formed of composition or plastic material similar or identical to the material of construction of the standard cue ball. In fact, if desired, the training device can be constructed as a "half" billiard ball with polished upper and lower surfaces to provide the indicia face 12 and the support face 74. Of course the device might also be constructed of glass or clear plastic, in which case the equivalent of the indicia means 28 and 30 of the device 10 might also be provided. These and many other variations in the construction and in the application of the invention will suggest themselves to those skilled in the art to which the present invention pertains, without departing from the spirit and scope thereof. Accordingly, it is not intended that the invention be limited to the specific embodiments herein illustrated and described, except as defined in the appended claims.

What is claimed is:

1. In a billiard training device for teaching the point of contact and correct point of aim for the cue ball, unitary means for simultaneously providing a visual indication of both the desired point of aim for the cue ball and the desired point of contact of the cue ball with respect to an object ball, said unitary means including a relatively flat indicator surface at a height between about 1-1/16 and 1-3/16 inches above the surface of the billiard table so as to approximate one half the height of the cue ball, said indicator surface including indicia means to locate both said point of aim and said point of contact, said unitary means additionally including support means to facilitate the positioning of said flat indicator surface in desired position immediately adjacent said object ball without interference with a player's visual determination of said point of aim and said point of contact.

2. A billiard training device as in claim 1 wherein said relatively flat indicator surface is circular in configuration and of a diameter equal to the diameter of said cue ball.

3. A device as in claim 2 wherein said indicia means includes a point indicator at the center of said circular surface and a point indicator at the peripheral edge of said circular surface.

4. A billiard training device as in claim 3 wherein said indicia means additionally includes a line indicator connecting said center and peripheral point indicators.

5. A billiard training device as in claim 1 wherein said support means is in the form of a right cylinder constructed of transparent material and said relatively flat indicator surface is the circular top surface of said cylinder.

6. A billiard training device as in claim 5 wherein an indicia for indicating point of aim is located on the axis of said right cylinder.

7. A billiard training device as in claim 6 wherein an indicia for indicating point of contact is located on the periphery of said cylinder on a vertical line parallel to the axis of said cylinder.

8. A billiard training device as in claim 7 wherein said indicia means includes an indicator line connecting said points for indicating the point of aim and point of contact.

9. A billiard training device as in claim 5 wherein vertical peripheral surfaces of said right cylinder are opaque so as to emphasize the visual indication presented by the indicia on the circular top surface of said cylinder.

10. A billiard training device as in claim 5 wherein said means for simultaneously providing visual indication of desired point of aim and desired point of contact include an indicia line coinciding with the axis of said cylinder, an indicia line on the periphery of said cylinder and parallel to the axis thereof, and at least one indicator line connecting said parallel indicia lines.

11. A billiard training device as in claim 1 wherein said support means is substantially in the form of a solid hemisphere having a top circular surface substantially equal in diameter to the diameter of said cue ball.

12. A billiard training device as in claim 11 wherein a bottom surface of said solid hemisphere is flattened to provide a small circular support base for said support means.

13. A billiard training device as in claim 11 wherein said solid hemisphere is constructed of transparent material.

14. A billiard training device as in claim 11 wherein said solid hemisphere is constructed of opaque material.

15. A billiard training device for visually indicating the point of contact, and for teaching the correct point of aim for a cue ball, comprising: unitary means having a top surface in the form of a substantially planar circular surface, the diameter of said circular surface being between about 2⅛ and 2⅜ inches so as to approximate the diameter of a standard cue ball as used in a billiard game, said unitary means including support means for said planar circular surface, said support means having a height substantially one half the diameter of said flat circular surface so as to approximate one half the height of said standard cue ball, whereby said flat circular surface can be positioned immediately adjacent an object ball at substantially one half the height thereof, said substantially planar circular surface being provided with indicia means in the form of a point of contact indicator at a peripheral edge of said circular surface and a point of aim indicator at the center of said circular surface, whereby said billiard training device can be positioned immediately adjacent an object ball with the point of contact indicator in contact with the object ball, and with both the point of contact and point of aim indicators along the desired line of travel of the object ball, to thus provide a correct indication of both the desired point of contact and a desired true point of aim.

16. A billiard training device as in claim 15 wherein said support means is in the form of a right cylinder, the top surface of which is said substantially planar circular surface.

17. A billiard training device as in claim 15 wherein said support means is in the form of a substantially solid hemisphere, the top surface of which is said substantially planar circular surface, the bottom of substantially solid hemisphere being provided with a flattened relatively small diameter circular surface which functions to retain the top circular surface in a horizontal plane.

* * * * *